US010493358B2

(12) United States Patent
Sattar et al.

(10) Patent No.: US 10,493,358 B2
(45) Date of Patent: Dec. 3, 2019

(54) MODIFIED PLAYING CARD SHUFFLER AND METHOD OF MODIFYING A PLAYING CARD SHUFFLER TO ACCOMMODATE PLAYING CARDS OF DIFFERENT SIZES

(71) Applicant: AGS LLC, Las Vegas, NV (US)

(72) Inventors: Nasr Faisal Sattar, Las Vegas, NV (US); Carlos Luis, Jr., Las Vegas, NV (US); Michael Nicholas Skorzov, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 102 days.

(21) Appl. No.: 15/442,416

(22) Filed: Feb. 24, 2017

(65) Prior Publication Data

US 2018/0243641 A1 Aug. 30, 2018

(51) Int. Cl.
*A63F 1/12* (2006.01)

(52) U.S. Cl.
CPC ..... *A63F 1/12* (2013.01)

(58) Field of Classification Search
CPC ..... A63F 1/12
USPC ..... 273/149 R
See application file for complete search history.

(56) References Cited

U.S. PATENT DOCUMENTS 2,815,214 A * 12/1957 Hall ..... A63F 1/12 221/241
5,096,197 A * 3/1992 Embury ..... A63F 1/12 273/149 R
6,651,982 B2 * 11/2003 Grauzer ..... A63F 1/12 273/149 P
6,698,756 B1 * 3/2004 Baker ..... A63F 1/12 273/149 R
7,036,818 B2 * 5/2006 Grauzer ..... A63F 1/12 273/149 R
D578,577 S 10/2008 Toyama
7,461,843 B1 * 12/2008 Baker ..... A63F 1/12 273/149 R
7,523,935 B2 4/2009 Grauzer et al.
7,854,430 B2 * 12/2010 Toyama ..... A63F 1/12 273/149 R (Continued)

FOREIGN PATENT DOCUMENTS

WO 2003/026751 4/2003
WO 2007/098197 8/2007

OTHER PUBLICATIONS

Written Opinion for International Application No. PCT/US2017/068717 dated Apr. 17, 2018, 4 pages.

(Continued)

*Primary Examiner* — John E Simms, Jr.
*Assistant Examiner* — Dolores R Collins
(74) *Attorney, Agent, or Firm* — Weide & Miller, Ltd.

(57) ABSTRACT

A card shuffler or other card handling apparatus defines a card receiving and/or dispensing area that accepts cards of multiple sizes. In one embodiment, structural elements such as sidewalls and an end-wall cause the card receiving/dispensing area to have a first size for accommodating cards of a first size. One or more spacers may be removably located in the card receiving/dispensing area, thus causing the card receiving/dispensing area to reduce the effective size of the receiving/dispensing area, such as to reduce its width, so as to accept or accommodate cards of a second size which is smaller than the first size.

20 Claims, 5 Drawing Sheets

(56) References Cited

U.S. PATENT DOCUMENTS

| | | | | |
|---|---|---|---|---|
| 7,900,923 | B2 * | 3/2011 | Toyama | A63F 1/14 209/534 |
| 7,971,881 | B2 * | 7/2011 | Toyama | A63F 1/12 209/534 |
| 7,988,152 | B2 * | 8/2011 | Sines | A63F 1/14 273/149 R |
| 8,038,521 | B2 * | 10/2011 | Grauzer | A63F 1/12 463/12 |
| 8,109,514 | B2 | 2/2012 | Toyama | |
| 8,366,109 | B2 * | 2/2013 | Soltys | A63F 1/10 273/149 P |
| 8,480,088 | B2 * | 7/2013 | Toyama | A63F 1/12 273/149 R |
| 8,602,416 | B2 * | 12/2013 | Toyama | A63F 1/12 273/149 R |
| 2004/0067789 | A1 * | 4/2004 | Grauzer | A63F 1/12 463/11 |
| 2013/0147166 | A1 | 6/2013 | Cowelchuk et al. | |
| 2014/0027979 | A1 * | 1/2014 | Stasson | A63F 1/12 273/149 R |

OTHER PUBLICATIONS

Search Report and Written Opinion for International Application No. PCT/US2017/068717 dated Apr. 17, 2018, 22 pages.

* cited by examiner

MODIFIED PLAYING CARD SHUFFLER AND METHOD OF MODIFYING A PLAYING CARD SHUFFLER TO ACCOMMODATE PLAYING CARDS OF DIFFERENT SIZES

BACKGROUND

Playing cards are used in a wide variety of games. When playing cards are used to play games in a casual setting, such as in the home, the cards are generally processed manually. In other words, the cards may be shuffled by hand, dealt by hand and the like.

In many environments, hand processing of cards for game play is undesirable or has drawbacks. For example, in a casino environment is important to ensure that the cards are not tampered with (where that risk increases the more the cards are handled by hand), that the cards are well shuffled (thus ensuring a high degree of randomization) and that the card handling is expedited so that games can be played quickly.

Thus, in order to address these issues, a number of card handling devices have been created. For example, to facilitate thorough and quick shuffling of cards, various mechanical or electro-mechanical card shuffling devices have been developed. In addition, other types of card handling, receiving, transporting and retaining devices have been developed.

One problem, however, is that playing cards come in various sizes. For example, standard playing cards having a length of 3.5 inches and a width of 2.5 inches. However, there are other sizes of cards that are commonly used, such as "bridge sized" cards which have a length of 3.5 inches and width of 2.25 inches. This variance in card sizes creates problems relative to card handling apparatus such as card shufflers which are configured to process or shuffle only cards of a single size, such as the larger standard size or the smaller bridge size.

One option for addressing this issue, which is undesirable, is for the casino to use only a single size of playing card corresponding to the design of the particular shuffler or other card handling apparatus which the casino utilizes. Another option is for the casino to buy and use different card shufflers and other card handling devices for different sized cards. This is also undesirable because these devices are generally very expensive and thus the cost of acquiring and maintaining duplicate equipment for different sized cards is prohibitive. Lastly, the casino might modify the equipment so that it can be used with different sized cards. For example, currently card shuffling apparatus exists which is designed to shuffle standard sized cards. This equipment might be manually modified to facilitate use with smaller sized cards. However, this process is time consuming and difficult, as it generally requires the casino to access interior portions of the shuffling apparatus and to use tools to modify the apparatus, such as by using fasteners to connect and/or disconnect one or more elements thereof. As noted, however, this process is time consuming and so can't readily be performed between games and the like (but essentially requires the game table to be taken out of use/service while the modifications are made) and is difficult (for example, fasteners such as screws may fall into the interior of the shuffler and interfere with its operation and the like).

An improved method and device(s) for easily modifying card handling apparatus, such as a card shuffler, so that such a device can accommodate different sized cards, is desired.

SUMMARY

Accordingly, there is a need for card shuffling or other card handling devices that may be quickly and easily modified to accommodate cards of various sizes, and for a method of quickly and easily modifying such devices. The disclosed embodiments have been developed in light of the above and aspects of the invention may include a shuffling apparatus that accommodates cards of multiple sizes.

In one embodiment, the shuffling apparatus includes a top plate that has an aperture or opening therein. At least one card receptacle, such as a card receiving and/or card dispensing area, is accessible through the aperture or opening. One or more structures define the card receptacle, such as the card receiving and/or dispensing area(s). In one embodiment, a card dispensing area is defined by a pair of opposing sidewalls, an end-wall, opposing arms, and supporting bottom plate.

The card receiving/dispensing area has a base configuration in which the size (height and width) of the receiving/dispensing area corresponds to playing cards of a first size. One or more spaces or adapters may be located in the receiving/dispensing area, such as by releasably attaching them to at least a sidewall, end-wall or bottom plate. The spacers re-size the receiving/dispensing area (by reducing the effective size thereof) to accept or accommodate playing cards of a second size, the second size being smaller than the first size. The first size of cards may be standard sized playing cards having a first width and the second size of cards may be bridge-sized playing cards having a second, reduced width, wherein the spacers reduce the width of the card receiving/dispensing area.

In some embodiments, means are provided for releasably connecting the spacers to the card shuffling apparatus. The spacers may comprise at least one connector configured attach to the at least one of the sidewalls, the end-wall and/or a bottom of the receiving/dispensing area. The at least one connector may be a male connector, such as a projection, that is configured to be attached to a female connector, such as a slot or opening, of the at least one of the sidewalls and end-wall.

According to another embodiment of the invention, a spacer or adapter is provided for a card shuffler or other card handling apparatus, which spacer allows a user to modify the apparatus to accommodate cards of multiple sizes. Each spacer may comprise a body having front face, a rear face, a flat top and a bottom. The bottom may include a cutout which defines a groove or inset in the rear face that extends upwards from the bottom for accepting spacer guides which extend outwardly from at least one of the sidewalls and/or the end-wall. The spacer may include one or more connectors or connecting elements, such as male connectors, to facilitate connection thereof to a card shuffler or other card handling apparatus.

According to another embodiment, a method for modifying a card shuffler or other card handling apparatus to fit cards of multiple sizes is provided. The method may include providing a shuffling apparatus that includes a card receiving and/or dispensing area having sidewalls, an end-wall, and supporting bottom plate. Spacer guides may project from at least one of the sidewalls and end-wall, and are configured to size the receiving/dispensing area to accept or accommodate playing cards of a first size.

In accordance with the method, spacers may be inserted over the spacer guides. The spacers are configured to be removably attachable to the at least one of the sidewalls, end-wall and bottom plate. When located in the card receiving/dispensing area, the spacer re-size the receiving/dispensing area to accept or accommodate playing cards of a second size, the second size being smaller than the first size.

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The disclosed embodiments described herein provide improvements and modifications to a card shuffling apparatus or other card receiving, processing, dispensing or retaining devices. Various embodiments of a card shuffling apparatus to which the present invention is applicable are disclosed in U.S. Pat. No. 8,602,416 ("the '416 patent"), the contents of which are incorporated by reference in their entirety. However, the present invention is, as indicated above, applicable to other configurations of card shuffling apparatus and various other card handling devices.

Figure 1:
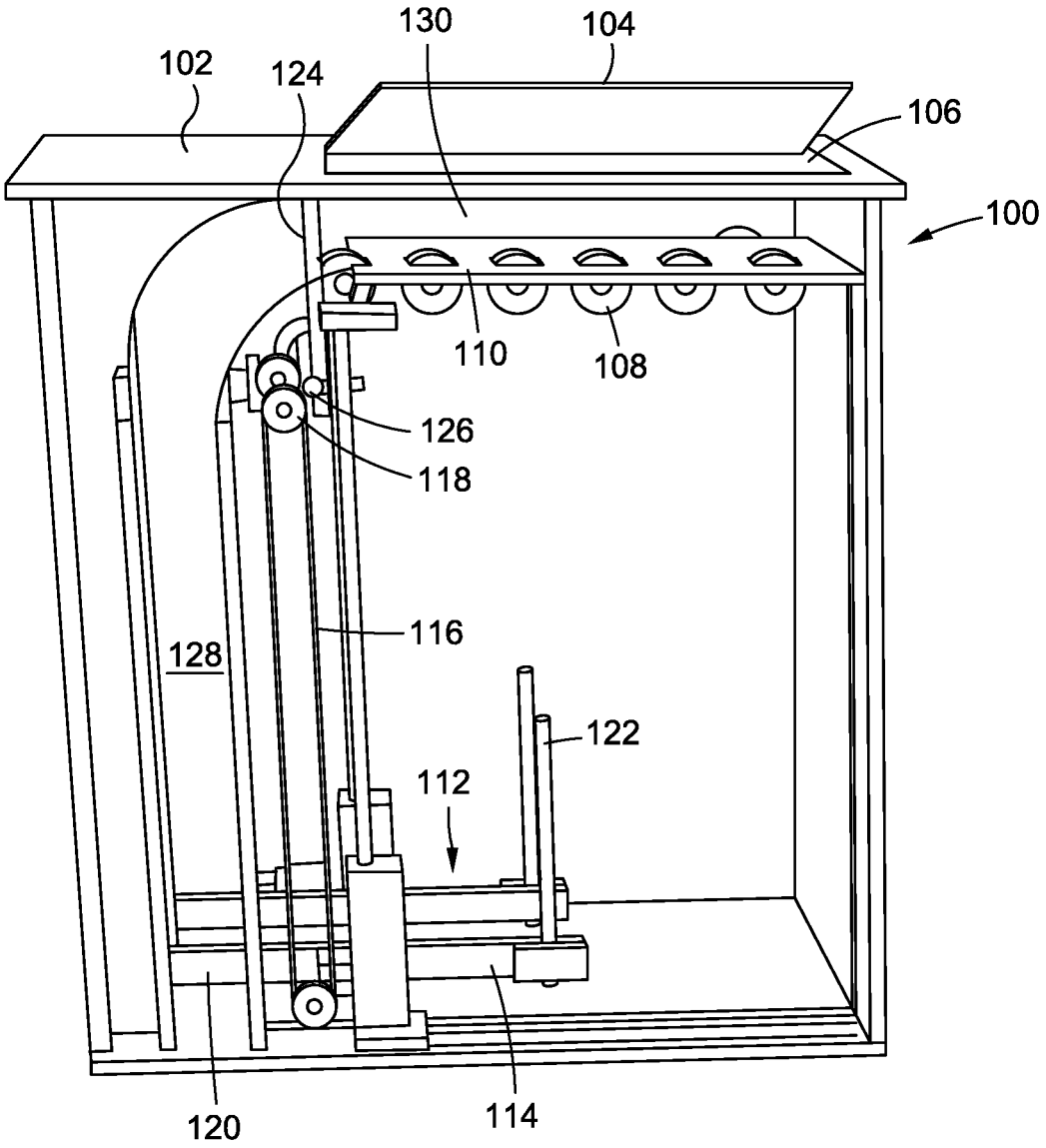
FIG. 1 shows an exemplary shuffling apparatus according to one embodiment.

For example, as explained in more detail in the '416 patent, an exemplary shuffling apparatus is shown in FIG. 1. Some specific details of the shuffling mechanism are not shown in FIG. 1 but are more particularly described in the '416 patent. For example, the particulars of a shuffler mechanism, a card counting device, and many of the associated belts, motors, sensors, and the like, that are associated with providing the motive force and control inputs needed for the functioning of the overall apparatus are omitted here for brevity.

In FIG. 1, a shuffling apparatus 100 comprises a top plate 102 may serve to form an interface with the top of a gaming table (not shown) and another plate 104 may be affixed thereto so as to form a swinging or sliding door in the top plate 102. The plate 104 covers an aperture 106 in the apparatus 100 that allows a deck of cards 15 (or more than one deck or partial decks; such decks might comprise standard 52 card decks having a back and a front, where the front or face displays card suit and rank information, such as card ranks of 2, 3, 4, 5, 6, 7, 8, 9, 10, Jack, Queen, King and Ace, in each of the suits Hearts, Spades, Clubs and Diamonds; such a deck might include one or more Jokers, and other/might comprise other types of cards bearing other information) to be introduced into the apparatus 100, or be removed from the apparatus 100 (see e.g. FIG. 2). In essence, the aperture 106 comprises an area, such as a recessed area, which serves as a card receptacle, such as a card dispending and/or receiving area. The region where a deck of cards 15 is to be removed may be fitted with an elevator mechanism (not shown) to raise the shuffled deck of cards out of the aperture 106, such as so that a bottom card of the deck of cards within the aperture 106 is at or above the level of the top plate 102.

When the plate (lid) 104 is opened, a user may place a deck of cards 15 (in this configuration, in a horizontal position) into a receiving area 130 at the aperture 106, such as so that they rest on a bottom or support plate 110 within the apparatus 100. A horizontal card transport assembly 108 is provided for moving the deck of cards 15 from the card receiving area 130 into the interior of the apparatus 100 to a shuffler mechanism. This horizontal card transport assembly 108 may comprise a series of rollers projecting through a support plate 110. The rollers may be rotated in unison by a belt, which may be a toothed belt, or a smooth belt. Alternatively, the transport mechanism may be a continuous belt, may include pushers to move the deck of cards 15 along the support plate 110, or the like. The horizontal card transport assembly may be actuated to move a deck of cards 15 from a right-hand-end of the apparatus to a left-hand-end of the apparatus (relative to the configuration illustrated in FIG. 3). In some designs, the belt may also be controllable to also translate in both directions to assist in positioning the cards for dispensing. Here, a shuffling compartment 128, of which the card shuffling apparatus may form a bottom portion thereof, is positioned at the left-hand-end of the horizontal transport mechanism. An elevator 112, including horizontal support arms 114 and a lifting belt 116 engaging with drive sprockets 118 operates to lift a deck of cards into and out of the shuffling compartment 128 while the cards rest on horizontal support arms 120.

Figure 3:
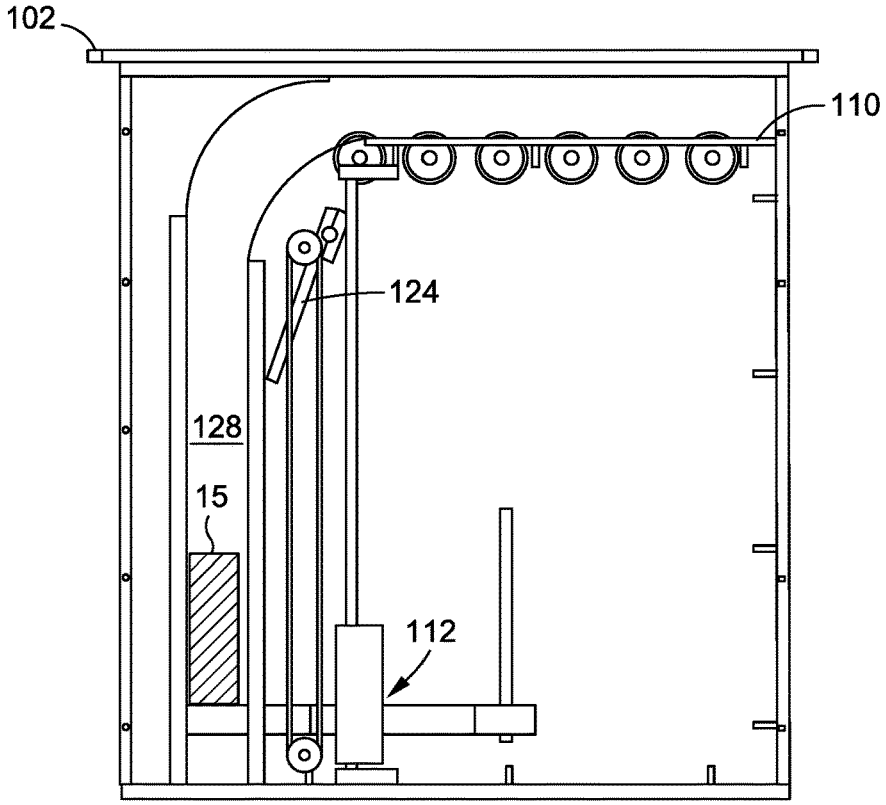
FIG. 3 shows a side view of the shuffling apparatus in a second state to shuffle cards.

As illustrated in FIG. 1, a pair of vertical shafts 122 may be affixed to the elevator 112 so that they rise and fall with the motion of the elevator 112. As illustrated in FIG. 3, a lift gate 124, such as in the form of a pair of spaced sweeper arms (shown in one embodiment in FIG. 3 and in another embodiment or form in FIGS. 4 and 5), is movable, such as by being rotatable about shaft 126 from a vertical position to a position about 180 degrees opposed thereto, depending on the state of the shuffling apparatus.

Figure 2:
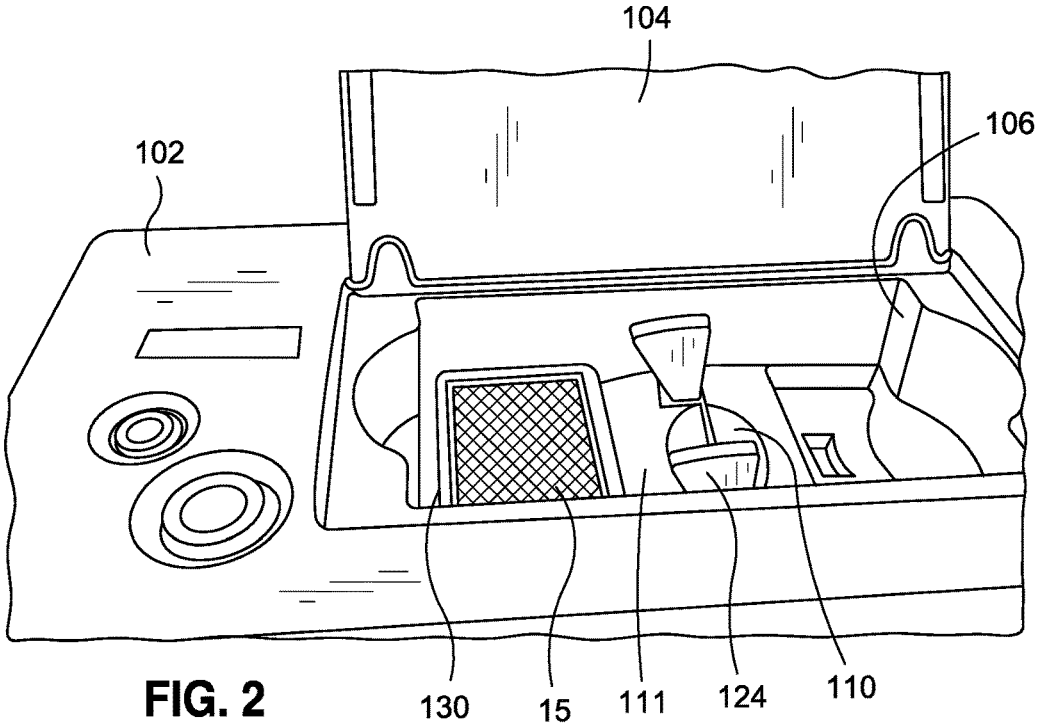
FIG. 2 shows a top perspective view of the shuffling apparatus in a first state receiving cards to be shuffled.

FIG. 2 shows a top perspective view of the shuffling apparatus 100 in a first state in which it is receiving cards to be shuffled. In the first state, a deck of cards 15 is inserted through the top aperture 106 to be positioned as shown in the card receiving area 130. The lift gate 124 (which may also be referred to as a sweeper arm or arms) may be rotated so that it does not obstruct the top of shuffling compartment 128 (FIGS. 1 and 3). The elevator mechanism 112 may be operated along with the horizontal transport mechanism 108 to move the deck of cards 15 to fall into the shuffling compartment 128 or to otherwise be transported or moved into the interior of the card shuffling device to a shuffler mechanism (FIG. 3).

In another embodiment, horizontal card transport 108 might have other configurations and/or be replaced with or include other card transport or delivery mechanisms. For example, as illustrated in FIG. 2, instead of using rollers or the like to move the cards, the support plate 110 may include a trap door 111 in the card receiving area 130. The trap door 111 may be configured to move between at least a first card supporting position where the trap door 111 is fixed in a generally horizontal position (and thus essentially forms a portion of the bottom 110 of the aperture 106), and a second delivery position where the trap door 111 swings into a generally vertical position where the cards are no longer supported by the trap door and thus fall downwardly into the shuffling compartment 128 (FIGS. 1 and 3). In this configuration, the deck of cards 15 is placed in the receiving area 130 on top of the trap door 111. To begin shuffling the cards, the trap door 111 is opened to allow the cards to fall, or be transported by the elevator mechanism 112 (or other card guide or transport mechanism), into the compartment 128 (FIGS. 1 and 3). The trap door 111 may be controlled by a series of switches, motors, pulleys, and/or belts as is now known or later developed and may move in various manners (swing, rotate, slide, etc.). Other suitable mechanisms may also be used to transfer the cards from the receiving area 130 to the compartment 128.

FIG. 3 shows a side view of the shuffling apparatus 100 in a second state to shuffle cards (once they have been delivered to the shuffling compartment 128 as described above). In this second state, a card shuffling operation may be performed in any manner, as is disclosed in the '416 patent. After completion of the card shuffling operation, the cards may be counted, providing a card counting device has been installed, for example, in the compartment 128 or aperture 106.

Figure 4:
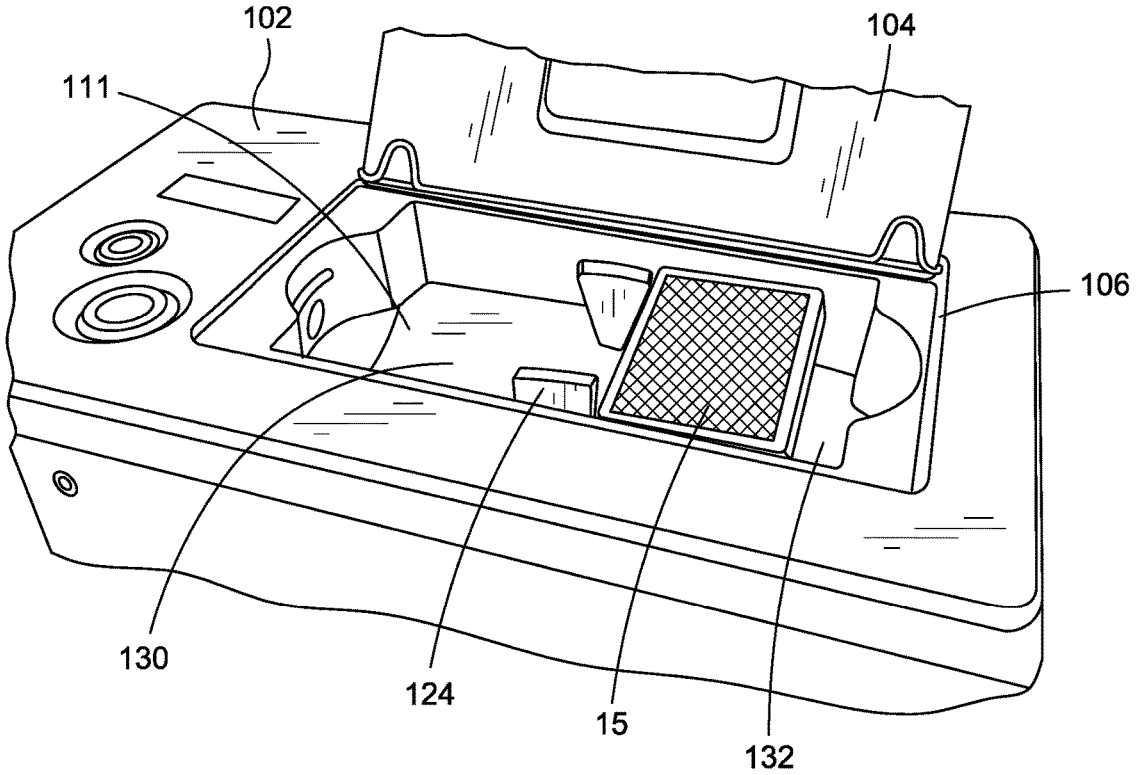
FIG. 4 shows a top perspective view of the shuffling apparatus 100 in a third state to dispense cards.

FIG. 4 shows a top perspective view of the shuffling apparatus 100 in a third state. In the third state, the elevator 112 is actuated to raise the deck of cards 15 to position them near the top of the shuffling compartment 128 and/or into the aperture 106 (the trap door 111 is opened to allow the cards to be raised upwardly into the aperture 106 and then closes once the cards are so delivered to enable the user to place another deck of cards in the receiving area to be shuffled). Once the shuffled deck of cards is raised into the aperture 106, the cards are moved to a card dispensing area 132, such as by way of the lift gate or sweeper arms 124 (such as by having the sweeper arms 124 rotate from a position under the aperture 106 in a clockwise direction in FIG. 4 so as to push the deck of cards from left to right in that figure) and/or the horizontal card transport assembly 108 (FIGS. 1 and 3). In this configuration, the aperture 106 comprises or defines a card receptacle which includes or defines a card receiving area 130 and a card dispensing area 132. However, in other embodiments, a single area might serve both as a location to receive and dispense cards, or the areas might be completely separate (and not part of the same aperture/receptacle area).

The shuffled deck of cards 15 may then be removed for use. The process may be repeated wherein another new or previously used deck of cards may be introduced into the receiving area 130. The removal of the cards from position 132, and the presence of cards at position 130 may be sensed, and used to initiate another shuffling cycle. The top cover 104 may be closed during the cycle and after use.

Ancillary equipment such as a power supply, which may be batteries, a AC-DC converter (battery eliminator), an AC power supply, a controller, or the like, are not shown as they are well known to persons of ordinary skill in the art, as are the various types of motors, displays, solenoids, control interfaces and the like.

With the shuffling apparatus described in FIG. 1-4, as well as other known shuffling apparatuses, there is the problem that they are built only to accommodate one size of cards. However, different sizes of cards are known. For example, narrow poker or bridge style playing cards, such as having dimensions of 2.25 inches in width by 3.5 inches in height, may be used at a gaming table in addition to standard size playing cards, such as having dimensions of 2.5 inches in width by 3.5 inches in height.

Figure 5:
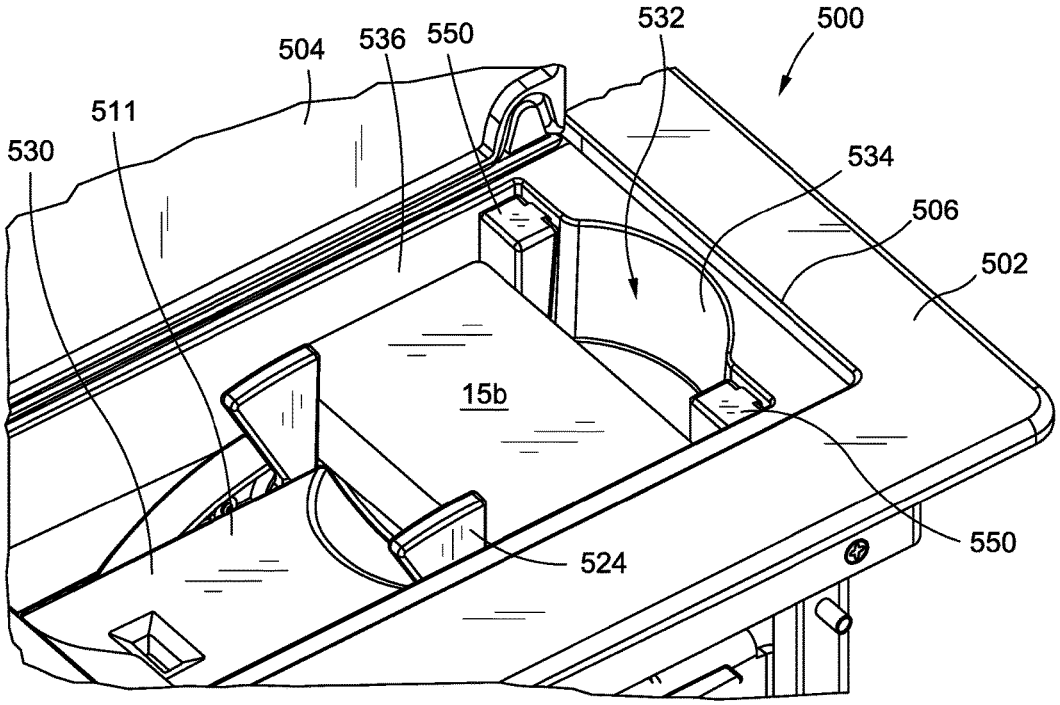
FIG. 5 shows a modified card shuffling apparatus, according to one exemplary embodiment.

FIG. 5 shows a modified card shuffling apparatus, according to one exemplary embodiment. It will be noted that various of the internal features of this modified card shuffling apparatus, such as the internal shuffling mechanism, etc., may have the configuration as just described. In FIG. 5, a card shuffling apparatus 500 has a top plate 502. The plate 502 forms a top of the card shuffling apparatus 500 and may be used to support the apparatus at a cutout or opening in a gaming table or to form an interface with the gaming table. The card shuffling apparatus 500 also has a retractable lid or cover 504 which may be mounted for movement between open and closed positions, such as via one or more hinges or the like. In the closed position, the cover 504 covers an aperture or recess 506 in the top plate 502 (and extending into the interior of a housing portion of the shuffling apparatus 500 below the top plate 502). The aperture or recess 506 comprises or define a card receptacle. In this embodiment, the receptacle defines or comprises both a card receiving area 530 and a card dispensing area 532, as described in more detail below. The shuffling apparatus 500 also has a card receiving area 530 which, in this embodiment, comprises a trap door 511 to drop the received cards into a shuffling compartment (not shown) in the manner described above.

Here, similar to the apparatus 100, a deck of cards **15*b* is shown in a dispensing area 532 of the aperture 506. In general, the dispensing area 532 comprises a defined space for containing a deck of playing cards. In this regard, the dispensing area 532** is preferably defined by walls or other structural features which engage the cards and/or otherwise restrict them to a particular area, preferably by engaging or surrounding the top, bottom and side edges of the cards, in order to maintain the cards in a particular location and in an aligned stack.

In FIG. 5, the deck of cards **15*b* is narrower than a standard deck of cards. Accordingly, the shuffling apparatus 500 includes one or more, and in this embodiment, two, card guide spacers or adapters 550 such that the shuffling apparatus 500 can accommodate cards of a reduced, and in this case narrower, card size. In other words, in this embodiment of the invention, the shuffling apparatus 500 has a base configuration designed to accommodate cards of a first, larger size and then the shuffling apparatus 500** may be modified to accommodate cards of a second, smaller size. In the preferred embodiment, the cards of the second size have the same height or length as the cards of the first size, but have a smaller width (e.g. are narrower) than the cards of the first size. Principles of the invention might be applied to accommodate cards having varying lengths/heights instead of varying widths, or having varying lengths and widths.

The card guide spacers 550 may be selectively located in the dispensing area 532. As indicated above, the dispensing area 532 is defined by one or more structures or elements which confine cards located therein, e.g. define a bounded location for a deck of cards. In the illustrated embodiment, the dispensing area 532 has a pair of opposing side walls 536 which correspond to the top and bottom of the cards (e.g. define the height dimension of the dispensing area), and has the end-wall 534 and the lift gate or sweeper arms 524 which engage or are positioned adjacent to the opposing sides of the cards (e.g. define the width dimension of the dispensing area). As noted, the top of the dispensing area 532 is generally open unless it is covered by the lid or cover 504. The dispensing area 532 also has a bottom on which a deck of cards may be placed or supported. The bottom may be defined by a bottom or support plate 510 or other element(s). Of course the card receptacle, such as the card dispensing area 532 or card receiving area 530 which may be modified as described herein, might be bounded or defined by other structures, whether such be one or more side walls, end walls or other features.

In this embodiment, the card guide spacers 550 are configured to abut against the interior end-wall 534 of the dispensing area 532. The interior end-wall 534 is configured to engage one side of the cards of a deck of cards where the playing cards have the first, larger size. As detailed herein, the card guide spacers 550 are configured to change the width-wise dimension of the dispensing area 532 to make it narrower by engaging or being positioned adjacent to the sides of the cards of a deck of cards where the playing cards have the second, smaller size.

Figure 6:
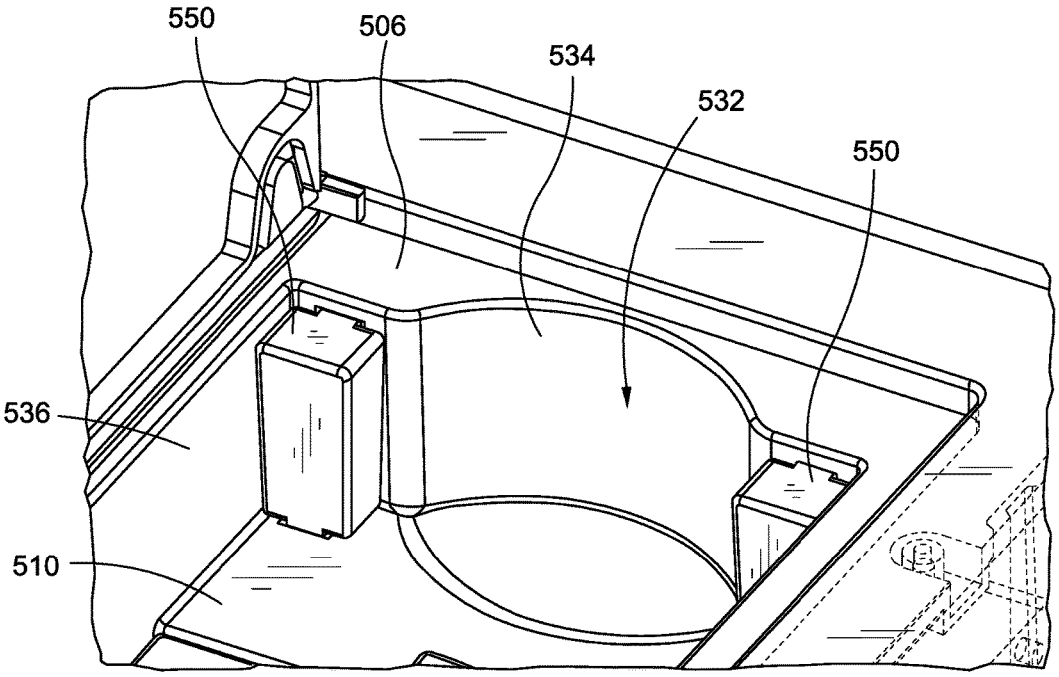
FIG. 6 shows a modified card shuffling apparatus without a deck of cards, according to one embodiment.

FIG. 6 shows a modified card shuffling apparatus without a deck of cards, according to one embodiment. As shown in FIG. 6, the card guide spacers 550 abut against and connect to the interior end-wall 534. In this embodiment, the spacers also abut against the respective sidewalls 536 of the aperture 506 at the dispensing area 532. Thus, the card guide spacers 550 fill in or occupy corners of the of the dispensing area 532 of the aperture 506. To further stabilize or fix the card guide spacers 550, the spacers are also connected to the support plate 510. Thus, the spacers card guide 550 extend from the support plate upwards into the dispensing area 532.

In the embodiment illustrated in FIG. 6, the interior end-wall 534 extends generally perpendicular to the side walls 536 (thus forming right or 90 degree angles at the corners therewith) and then curves or bows outwardly between those corners, thus causing the dispensing area 532 to have a concavity which allows a user to place their fingers along the side of a deck of cards in the dispensing area 532. It will be appreciated that the dispensing area 532, including the end-wall 534, might have other shapes or configurations, such as where the end-wall 534 is straight or where the entirety of the end-wall 534 is curved. In such embodiments, the configuration or shape of each card guide spacer 550 may vary to that the card guide spacers 550 extend inwardly from the end-wall 534 of the dispensing area 532, thus reducing the width of the dispensing area 532.

Figure 7:
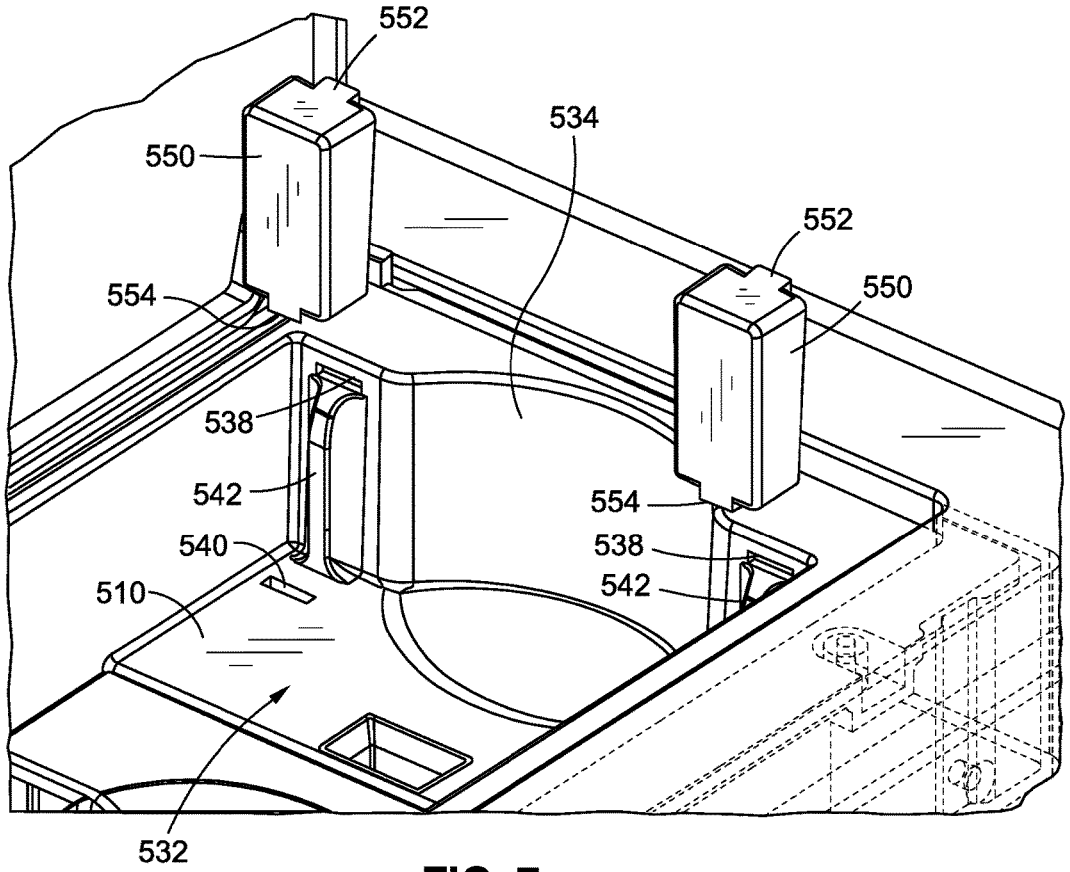
FIG. 7 shows an exploded view of the modified cards shuffling apparatus of FIG. 6.

FIG. 7 shows an exploded view of the modified card shuffling apparatus of FIG. 6. As shown in FIG. 7, the end-wall 534 may comprise one or more female connectors 538. These female connectors 538 are configured to receive male connectors 552 on the card guide spacers 550. The connectors may be, for example, snap-and-click connectors where the male connectors 552 comprise an extension or tab, such as having a lip or flange that clicks or snaps into the female connectors 538, such as an aperture which accepts the male connector 552, to secure the connectors 538, 552 in place. Similarly, the support plate 510 comprises female connectors 540 that correspond with male connectors 554 of the card guide spacers 550. Of course, it is also possible for the configurations of the connectors to be reversed in some situations. For example, male connectors might extend from the end-wall 534 for engagement with female connectors on the spacers.

In the illustrated embodiment, the card guide spacers 550 are unitary bodies, such as constructed in a molding process. In this configuration, the male connector 552 may simply comprise an extension or portion of the body of the card guide spacer 550. In other embodiments, the male connector 552 might be a separate element which is connected to the card guide spacer 550. In some embodiments, the card guide spacers 550 may be connected by a bridge member. This would facilitate quick, easy, and simultaneously attachment and removal of both the card guide spacers 550.

It will also be appreciated that other means might be provided for releasably connecting or mounting the card guide spacers 550 to the shuffler apparatus. Most importantly, the means for releasably connecting preferably allows a user to connect the card guide spacer 550 to the card shuffling apparatus 500 and release or disconnect the card guide spacer 550 from the card shuffling apparatus, without the need for tools or separate fasteners. The means for releasably connecting also preferably does not interfere with the use of the dispensing area 532 when the card guide spacers 550 are not used (for example, it is undesirable for elements to project upwardly into the dispensing area 532 that would interfere with the positioning of the cards in that area). Thus, the means for releasably connecting might comprise other features, such biased tabs, pins which engage slots (including slots with offset locking areas, etc.), and which allow the card guide spacers 550 to be moved into a locking position where some force is necessary to dislodge the card guide spacer 550. In one embodiment, the means for releasably connecting is configured to generate or provide a biasing or locking force (for example, in the illustrated embodiment, the top male connector 552 may be configured to be pressed downwardly slightly in order to engage the female connector or opening 538, and thus once so connected, to press upwardly upon the end-wall to generate a slight locking force).

Also, while in the illustrated embodiment the card guide spacers 550 connect or mount to the end-wall 534 and the bottom or support plate 510, the card guide spacers 550 could connect to the side walls 536 or the like—so long as the card guide spacers 550 can be maintained in a fixed position within the dispensing area 532 during use and, as described above, be easily placed and removed without tools and fasteners.

In one embodiment, the end-wall 534 further comprises spacer guides 542 projecting outwardly therefrom. The spacer guides 542 are configured to guide the card guide spacers 550 into position allowing the card guide spacers 550 to be easily connected to the connectors 538, 540 and may also help maintain the card guide spacers 550 in position during use. The spacer guides 542 are also configured, in conjunction with the remaining structure around the dispensing area 532 so that the dispensing area 532 has a size which accepts or accommodates a larger sized deck of cards when the card guide spacers 550 are removed. In one embodiment, the spacer guides 542 may be formed integrally with the end-wall 534, but in other embodiments, they might be separate elements which are connected to the end-wall 534.

As illustrated, the spacer guides 542 comprise projecting portions of the end-wall 534. The spacer guides 542 are sized to fit within or be received by the card guide spacers 550. The spacer guides 542 may also be shaped to facilitate this connection, such as by having a curved top and bottom and narrowing from the end-wall 534 as the guide projects outwardly.

It should be noted that while the above embodiment refers to the card guide spacers 550 and spacer guides 542 accommodating differently sized decks of cards in a dispensing area 532 of the shuffling apparatus 500, the invention is not limited to such. For example, the card guide spacers 550 and spacer guides 542 may be applied to a receiving area of the shuffler, or an area designated for both receiving and dispensing cards, or the like. Also, while in the embodiment which is illustrated the dispensing area 532 is located below a top plate 502 and cover 504, the dispensing area 532 (or other card storage or receiving area) might have other locations or configurations. For example, the dispensing area 532 might not be located under a cover or might comprise a raised or raisable area or compartment (for example, the card dispensing area 532 might comprise a compartment to which cards are moved and then raised upwardly, such as out of the card shuffling apparatus 500).

Figure 8:
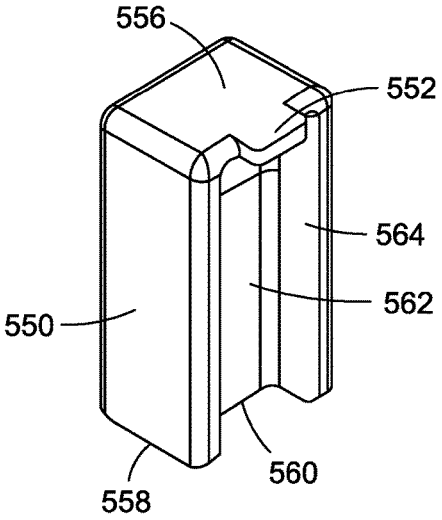
FIG. 8 shows a perspective view of a spacer, according to one exemplary embodiment.

FIG. 8 shows a perspective view of a spacer or adapter 550, according to one exemplary embodiment. As shown in FIG. 8, the card guide spacer 550 includes a top end 556 and a bottom end 558. The top end 556 is formed to be a closed flat surface in this embodiment, and defines or includes the outwardly extending male connector 552 (for engagement with the female connector 538 of the end-wall 534). The bottom end 558 defines or includes the downwardly extending male connector 554 (see FIG. 7) (for engagement with the female connector 540 of the support plate 510) and a cutout 560 that extends upwards and forms a groove or inset 562 in a rear face of the card guide spacer 550. The groove 562 is defined by sidewalls 564 that extend upwards on both sides of the groove 562. The groove 562 terminates prior to the top end 556 such that the top end 556 remains flat. The groove 562 is configured to correspond with (and accept therein) the spacer guide 542 (FIG. 7) to easily install the card guide spacer 550 over the spacer guide 542. The opposing front face of the card guide spacer 550 is preferably generally flat and smooth (as such defining an abutting surface to a side edge of playing cards located in the dispensing area 532).

In use, the card shuffling apparatus 500, without the card guide spacers 550, accommodates cards of the first, larger size. In this configuration, cards may be provided to the card shuffling apparatus 500, be shuffled, and then be delivered to the card dispensing area 532. Without the card guide spacers 550, the card dispensing area 532 has sufficient height and width to accommodate the larger sized cards (but preferably the dispensing area 532 still confines the cards therein). A user, such as a dealer, may then remove the cards from the dispensing area 532.

If the second, smaller sized cards are to be used, then a user may place the card guide spacers 550 in the dispensing area 532. In the preferred embodiment, the user simply aligns the card guide spacers 550 with the spacer guides 542 and then engages the male connectors 552,554 with the female connectors 538,540 of the dispensing area 532, thus securing the card guide spacers 550 to the card shuffling apparatus. In the illustrated embodiment, the user may lower each card guide spacer 550 so that its bottom male connector 552 passes into the corresponding female connector or aperture 540 in the bottom plate 510. The user may then rotate the top of each card guide spacer 550 towards the end-wall 534 and, while pressing slightly downwardly, push the top male connector 552 into engagement with the female connector or aperture 540 of the end-wall 534. Once released, the card guide spacer 550 creates an upward biasing force which locks the card guide spacer 550 into place.

Most advantageously, this process may be accomplished by the user by simply pressing the card guide spacers 550 into place without the need for tools or separate fasteners. At that time, the dimensions of the dispensing area 532 are effectively reduced (by, in this case, reducing the effective width of the dispensing area 532). Thus, when smaller dimension cards are delivered to the dispensing area 532, they are maintained in an aligned and stacked/orderly state and configuration in the dispensing area 532, including for ease of removal by a user.

At the same time, if the user wishes to reconvert the card shuffling apparatus 500 back to use with larger dimension cards, the user can easily remove the card guide spacers 550. The user may, for example, apply a downward force to the card guide spacers 550 overcome the bias/locking force associated with the connectors and then rotate the spacers away from the end-wall 534 and upwardly from the bottom plate 510 to remove the spacers—preferably again without the use of tools.

Of course, if the card shuffling apparatus 500 or other device includes both a card receiving area and a card dispensing area, both might be fitted with spacers in a similar manner in order to facilitate use of smaller dimension cards (and the spacers may be removed to accommodate use of larger sized cards).

In the present embodiment, where the first, larger sized cards have a width of 2.50 inches and the second, smaller sized cards have a width of 2.25 inches, the card guide spacers 550 have a depth (from the front face to the rear face) of about 0.25 inches, thus effectively reducing the width of the dispensing area 532 by 0.25 inches. Of course, the card guide spacers 550 might have other dimensions depending upon the different sizes of the cards. In addition, by providing card guide spacers 550 of different dimensions, more than two different sized cards might be accommodated. For example, the card shuffling apparatus 500 or other device might have a base configuration which accommodates a first large sized card, and via use of a first set of spacers accommodate a second smaller sized card, and via yet another second set of spacers accommodate a third even smaller sized card.

While the card shuffling apparatus 500 has been described herein as accepting and dispensing a deck of cards, the invention may be utilized with card shuffling apparatus 500 or other devices which accept, dispense, receive, process, or retain individual cards, sets of cards, a deck of cards, multiple decks of cards or the like.

In the illustrated embodiment, two card guide spacers 550 are utilized to modify the dispensing area 532 of the card shuffling apparatus 500. Of course, depending upon the application, as few as one spacer might be utilized or more than two might be utilized. Further, depending upon the application, the configuration of the spacer(s) might vary. For example, instead of utilizing two spacers on either side of a finger cut-out, a single spacer might be provided in between two spaced apart finger cut-outs, etc.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A shuffling apparatus comprising:

a card receptacle located above a card shuffling area, said card receptacle having one or more sidewalls and at least one end-wall that define a card receiving/dispensing area configured to receive a plurality of cards to be delivered to said card shuffling area there below for shuffling;

spacer guides projecting from at least one of the sidewalls and end-wall, the spacer guides being configured to size the receiving/dispensing area to fit playing cards of a first size; and spacers configured to be removably attachable to the at least one of the sidewalls and end-wall, the spacers fitting over the spacer guides, and the spacers sizing the receiving/dispensing area to fit playing cards of a second size, the second size being smaller than the first size.

2. The shuffling apparatus of claim 1, wherein the spacers further comprise at least one connector configured attach to the at least one of the sidewalls and end-wall.

3. The shuffling apparatus of claim 2, wherein the at least one connector is a male connector that is configured to be attached to a female connector of the at least one of the sidewalls and end-wall.

4. The shuffling apparatus of claim 1, wherein the spacers comprise a flat top and a bottom having a cutout defining a groove that extends upwards from the bottom, and wherein the spacer guides are received into the groove when the spacers are attached to the at least one of the sidewalls and end-wall.

5. The shuffling apparatus of claim 1, wherein the cards of a first size are standard sized playing cards and the size of the second cards are bridge-sized playing cards.

6. The shuffling apparatus of claim 1, wherein the spacers are removably attachable to the supporting bottom plate.

7. The shuffling apparatus of claim 1, wherein said card receptacle extends downwardly from a top of said shuffling apparatus, said top forming an interface with a top of a gaming table.

8. A method for modifying a card shuffling apparatus to fit cards of multiple sizes, the method comprising:

providing a shuffling apparatus comprising:

a card receptacle located above a card shuffling area, said card receptacle having one or more sidewalls and at least one end-wall that define a card receiving/dispensing area configured to receive a plurality of cards to be delivered to said card shuffling area there below for shuffling; and spacer guides projecting from at least one of the sidewalls and end-wall, the spacer guides being configured to size the receiving/dispensing area to fit playing cards of a first size;

inserting spacers over the spacer guides, the spacers being configured to be removably attachable to the at least one of the sidewalls and end-wall, and the spacers sizing the receiving/dispensing area to fit playing cards of a second size, the second size being smaller than the first size.

9. The method of claim 8, wherein the spacers further comprise at least one connector configured attach to the at least one of the sidewalls and end-wall.

10. The method of claim 9, wherein the at least one connector is a male connector that is configured to be attached to a female connector of the at least one of the sidewalls and end-wall.

11. The method of claim 8, wherein the spacers comprise a flat top and a bottom having a cutout defining a groove that extends upwards from the bottom, and wherein the spacer guides are received into the groove when the spacers are attached to the at least one of the sidewalls and end-wall.

12. The method of claim 8, wherein the cards of a first size are standard sized playing cards and the size of the second cards are bridge-sized playing cards.

13. The method of claim 8, wherein said card receptacle has a bottom and the spacers are removably attachable to the bottom.

14. A shuffling apparatus comprising:

a card receptacle located above a card shuffling area, said card receptacle having one or more sidewalls and at least one end-wall that define a card receiving area configured to receive a plurality of cards to be delivered to said card shuffling area there below for shuffling;

spacer guides projecting from at least one of the sidewalls and end-wall, the spacer guides being configured to size the receiving area to fit playing cards of a first size; and spacers configured to be removably attachable to the at least one of the sidewalls and end-wall, the spacers fitting over the spacer guides, and the spacers sizing the receiving area to fit playing cards of a second size, the second size being smaller than the first size.

15. The shuffling apparatus of claim 14, wherein the spacers further comprise at least one connector configured attach to the at least one of the sidewalls and end-wall.

16. The shuffling apparatus of claim 15, wherein the at least one connector is a male connector that is configured to be attached to a female connector of the at least one of the sidewalls and end-wall.

17. The shuffling apparatus of claim 14, wherein the spacers comprise a flat top and a bottom having a cutout defining a groove that extends upwards from the bottom, and wherein the spacer guides are received into the groove when the spacers are attached to the at least one of the sidewalls and end-wall.

18. The shuffling apparatus of claim 14, wherein the cards of a first size are standard sized playing cards and the size of the second cards are bridge-sized playing cards.

19. The shuffling apparatus of claim 14, wherein the spacers are removably attachable to the supporting bottom plate.

20. The shuffling apparatus of claim 14, wherein said card receptacle extends downwardly from a top of said shuffling apparatus, said top forming an interface with a top of a gaming table.

* * * * *